US008477172B2

(12) United States Patent
Hoerl et al.

(10) Patent No.: US 8,477,172 B2
(45) Date of Patent: Jul. 2, 2013

(54) APPARATUS AND METHOD FOR WRITING A FLIP IMAGE STRUCTURE

(75) Inventors: Michael Hoerl, Recklinghausen (DE); Karl Hoelterhoff, Beckum (DE)

(73) Assignee: Alltec Angewandte Laserlicht Technologie Gesellschaft mit beschrankter Haftung, Selmsdorf (DE)

( * ) Notice: Subject to any disclaimer, the term of this patent is extended or adjusted under 35 U.S.C. 154(b) by 333 days.

(21) Appl. No.: 12/674,816

(22) PCT Filed: Jul. 23, 2008

(86) PCT No.: PCT/EP2008/006051

§ 371 (c)(1),
(2), (4) Date: Apr. 7, 2010

(87) PCT Pub. No.: WO2009/043402

PCT Pub. Date: Apr. 9, 2009

(65) Prior Publication Data

US 2011/0128345 A1 Jun. 2, 2011

(30) Foreign Application Priority Data

Sep. 27, 2007 (EP) ..... 07019074

(51) Int. Cl.
*B41J 15/14* (2006.01)
*B41J 27/00* (2006.01)

(52) U.S. Cl.
USPC ..... 347/241; 347/256

(58) Field of Classification Search
USPC ..... 347/224, 225, 231, 241–244, 256–260; 355/22, 33, 44–46
See application file for complete search history.

(56) References Cited

U.S. PATENT DOCUMENTS

| | | | | |
|---|---|---|---|---|
| 2,036,498 | A * | 4/1936 | Rantsch | 355/34 |
| 4,463,074 | A * | 7/1984 | Gilmour et al. | 430/7 |
| 5,192,969 | A * | 3/1993 | Igarashi et al. | 355/22 |
| 5,302,989 | A * | 4/1994 | Taguchi et al. | 355/22 |
| 6,252,621 | B1 * | 6/2001 | Kessler et al. | 347/233 |
| 7,126,900 | B2 * | 10/2006 | Hendriks et al. | 369/112.01 |

FOREIGN PATENT DOCUMENTS

| | | |
|---|---|---|
| DE | 10 2005 054 396 A1 | 6/2006 |
| EP | 0 219 012 A2 | 4/1987 |
| WO | WO 2005/058610 A2 | 6/2005 |

OTHER PUBLICATIONS

PCT, "International Preliminary Report on Patentability and Written Opinion", Date of Report Apr. 20, 2010, 5 pages.
PCT "International Search Report", International Application No. PCT/EP2008/006051, Date of Mailing the International Search Report, Feb. 5, 2009.

* cited by examiner

*Primary Examiner* — Hai C Pham
(74) *Attorney, Agent, or Firm* — Matthew B. Pinckney; Hoffman Warnick LLC

(57) ABSTRACT

The invention relates to an apparatus for writing a flip image structure on a base. Said apparatus comprises a laser light source that has a control device for specifically modifying an angle at which the laser light emerges from the laser light source, and a holder for the base. According to the invention, two deflection elements for the laser light are provided in the beam range of the laser light source. Said deflection elements are arranged such that laser light of the laser light source that is deflected, especially reflected by the deflection elements is incident on the flip image structure of the base accommodated on the holder at a different angle of incidence. The invention further relates to a method that can be carried out especially by means of a disclosed apparatus.

12 Claims, 5 Drawing Sheets

APPARATUS AND METHOD FOR WRITING A FLIP IMAGE STRUCTURE

FIELD OF THE INVENTION

The invention relates to a device for writing a tilt image structure on a base body, in particular on an identification card. A device of such type is designed with a laser light source, which has a control means for selectively modifying an angle of emergence of the laser light from the laser light source, and a holder for the base body.

The invention further relates to a method for writing a tilt image structure on a base body, in particular on an identification card. In the method laser light is generated by a laser light source, with an angle of emergence of the laser light from the laser light source being selectively modified by means of a control means.

RELATED ART

As a security feature for identification cards, as for example bank cards and official documents such as passports, so-called tilt images are known. These tilt images, which can also be referred to as "flip images" and which can be designed in particular as lenticular screen images, show a different image depending on the viewing angle $\phi$, for instance +15° or −15°.

A tilt image can be based, in particular, on a transparent line screen of parallel running cylindrical lenses or prisms that are applied onto the surface of the identification card. Behind this screen structure an optical information structure is arranged. Depending on the viewing angle the screen structure focuses on a different part of the information structure so that different images become visible in different directions of view.

Especially when making use of cylindrical lenses a tilt image can also contain more than two individual images. In particular, the tilt image can also vary continuously with the viewing angle and convey a three-dimensional image impression.

For the production of tilt images it is known from prior art that at first the lens screen, in particular the prism lens screen, is imprinted onto the transparent cover layer of the card. Subsequently, the card is introduced into a laser writing machine. In this writing machine the card normally runs through several stations where it can be inscribed, among other things, with text and/or image information. To write on the tilt image in the so-called CLI-method (changeable laser image method) or MLI-method (multiple laser image method) the card is then tilted by an angle $\phi$ in a mechanical tilt station that is normally separate. Following the tilting a first image is applied through the lenticular screen structure with a laser. Subsequently, a tilting by the angle $2\times\phi$ is effected in the counter-direction so that the card is then tilted by the angle $-\phi$. With a laser the second image is then applied through the lens structure. The angle $\phi$ can amount to 15° for example.

In this way the "flip image" is created on the inscribed card. In the case of this image the viewer also has to adopt an angle of approximately $+\phi$ or $-\phi$ in order to be able to see the one or the other laser-produced image in maximum contrast.

However, for this kind of writing a comparatively complicated mechanical construction is required that ensures tilting of the card in the shortest possible time.

A method and a device for inscribing a cylindrical lens image are known from EP 0 219 012 A2. This printed publication teaches a laser writing method, in which the card, following the writing of a first image information, is tilted by a specific angle. Alternatively, according to EP 0 219 012 A2 provision can be made for the angle of irradiation to be modified by placing prisms into the beam path. However, this procedure can also prove to be comparatively time-consuming and complicated, because with the prisms a comparatively large mass has to be moved. If a great number of cards are to be inscribed, it may be necessary to readjust the prisms repeatedly during each writing process, which may limit the throughput.

SUMMARY OF THE INVENTION

The object of the invention is to provide a device and a method for writing on a tilt image structure, which permit an especially high throughput of the structures to be inscribed with the minimum of mechanical effort required.

The object is solved in accordance with the invention by a device having the features described herein and by a method having the features described herein.

The device according to the invention is characterized in that in the beam area of the laser light source two deflection elements for the laser light are provided, with the deflection elements being arranged such that laser light of the laser light source that is deflected, in particular reflected by the said deflection elements is in each case incident on the tilt image structure of the base body accommodated on the holder at a different angle of incidence.

An idea of the invention can be seen in the fact that, in contrast to what is known from prior art, the angle of incidence of the laser light on the tilt image structure is not modified by tilting the base body but rather through a variation of the beam path. Hence, according to the invention writing is not effected directly from the laser light source onto the base body but via the detour of the deflection elements. These deflection elements are arranged such that the angle of incidence of the laser light deflected on them lies on the base body in the area required for producing the tilt image.

In accordance with the invention the mechanically complex tilt station can therefore be dispensed with and the tilt image can be applied in comparatively short time. Moreover, according to the invention no additional movable optical elements are necessary that might have a negative effect on the rate of throughput. Instead, the different tilt angles are generated in the writing process through a variation of the beam path on the part of the laser light source, which is in any case designed with a variable beam path for the purpose of writing on the tilt image structure.

The tilt image structure concerned can be e.g. a laser-writable information carrier structure on which a lenticular screen structure is provided. According to the invention this information carrier structure is inscribed with laser light through the lenticular screen structure.

The control means suitably has a laser scanner which can include for example two movable mirrors for adjusting the beam path in two spatial directions. For best suitability, writing on the tilt image structure takes place in a point-scanning method, in which the tilt image structure is scanned completely for example and the intensity of the laser light is varied according to the desired image information.

Advantageously, during writing on the tilt image structure the base body is not moved, at any rate it is not tilted. However, for an especially versatile image design a movement of the base body during writing on the tilt image can be provided, too.

For best suitability, the laser light is a laser beam. The deflection elements are preferably arranged such that laser light deflected by them is in each case incident on the tilt image structure at least approximately at the same angle of incidence in terms of amount but with a different sign of the angle of incidence.

A further development of the invention resides in the fact that the deflection elements are arranged in an axially symmetrical manner. The axial symmetry can be present, in particular, with respect to the optical axis of the laser light source and/or a surface normal of the tilt image structure. Alternatively or additionally, provision can be made for a mirror symmetry to a mirror plane that can extend in particular parallel to the longitudinal direction of the lenticular screen structure, i.e. in particular parallel to the longitudinal direction of the parallel arranged lenses of the tilt image structure. By way of such a symmetrical arrangement the effort needed for actuating the control means can be reduced. Advantageously, the holder for the base body is arranged such that the optical axis of the laser light source is positioned perpendicularly on the tilt image structure of the accommodated base body and/or that the laser light source lies on a surface normal of the tilt image structure. Since the tilt image structure normally has a surface provided with a screen the term "surface normal" is to be understood in the macroscopic sense. More particularly, the surface normal of the tilt image structure can be understood as the surface normal of its information carrier structure and/or the surface normal of the rear side of the lenticular screen structure that is not provided with a screen. The surface normal can be indicated relative to the writing plane in particular.

Furthermore, in accordance with the invention it is especially advantageous that at least one deflection element, more particularly both deflection elements, is/are formed as deflection mirrors. As a result, a particularly simple and also compact construction of the device can be achieved. By preference, the at least one deflection mirror is formed as a plane mirror. If the deflection elements are formed as mirrors a reflection of the laser output of the laser light source may be necessary, since the image generated via the deflection mirrors is inverted. As an alternative or in addition to a deflection mirror for example a deflecting prism can also be provided.

If the two deflection elements are formed as deflection mirrors it is of particular advantage that the deflection mirrors have mirror surfaces that extend at least approximately parallel to each other. In this way an especially simple image generation is ensured. Moreover, according to the invention it is of advantage that the mirror surface of at least one deflection mirror is tilted with respect to the optical axis of the laser light source and/or the surface normal of the tilt image structure, in particular towards the laser light source. As a result, an especially small-angled incidence of light onto the tilt image structure can be realized at compact dimensions.

Advantageously, the holder is arranged such that the tilt image structure of the base body accommodated thereon is arranged centrally with respect to the two deflection elements. It is preferred that the two deflection elements have the same distance to the tilt image structure of the base body accommodated on the holder. This leads to a further simplification of the image production. Alternatively, provision can also be made for the two deflection elements to have a different distance to the tilt image structure of the base body accommodated on the holder. In this way the dimension of the device can be adapted to geometrical specifications.

A particularly versatile device is provided in that between the deflection elements a free space is formed which permits a direct irradiation of the base body with the laser light of the laser light source. In the case of such an arrangement it is rendered possible that, in addition to the tilt image structure, further surface areas of the base body can also be written on in an especially easy way with the laser light of the laser light source without having to move the base body for this purpose. For instance provision can be made for additional text and/or image information to be written onto the surface of the base body next to the tilt image by means of the laser light source, and for this purpose the laser light can be transmitted directly, i.e. without deflection on the deflection elements, from the laser light source to the base body. The size of the deflection elements and/or their distances to the writing plane on the base body and/or to the lens of the laser light source can be chosen depending on the application in question such that a maximum writing field can be written on directly, i.e. without deflection on the deflecting elements.

Another preferred further development of the invention resides in the fact that at least one of the deflection elements is pivotable. A pivoting capacity can be present in particular about an axis extending perpendicularly to the optical axis of the laser light source and/or to the surface normal of the lenticular screen structure. For example by pivoting the deflection elements by a few degrees the exact angle, e.g. for the center of the tilt image structure field, can be adjusted precisely. To pivot the deflection element at least one adjusting screw can be provided for example.

Another preferred embodiment of the invention resides in the fact that a focus of the laser light source lies in the beam direction behind the deflection elements. This embodiment proves to be especially advantageous in small tilt image structures and can, in this case, obviate the need for a flat field lens, in particular a so-called F-theta optical system. However, for an especially high image quality in larger tilt image structures in particular it can also be of advantage that a flat field lens, in particular an F-theta optical system, is provided. A focus lying behind a deflection element can be understood in particular in that the focus lies in the beam path on the side of the element facing away from the laser light source.

The versatility can be additionally enhanced in that further, preferably pivotable mirrors, prisms and/or transmissive elements are provided, which are arranged in a fixed manner in the beam path of the laser light source or can be moved, in particular pivoted into the beam path. These optical elements suitably have variable angles.

In particular, a preferred embodiment of the invention resides in the fact that a total of four deflection elements are provided. For example provision can be made for two of these deflection elements to be arranged for writing a first partial image of the tilt image structure and for the two remaining ones to be arranged for writing a second partial image of the tilt image structure. Thus, in each writing process two of the four deflection elements are preferably arranged at a time in the current beam path. Alternatively, provision can also be made for all four deflection elements to be arranged such that laser light of the laser light source that is deflected, in particular reflected by the deflection elements is in each case incident on the tilt image structure of the base body accommodated on the holder at a different angle of incidence. In this manner a tilt image with four partial images can be produced, i.e. with four different images that become visible depending on the viewing angle. Should several partial images be desired the number of deflection elements can be increased accordingly.

Furthermore, according to the invention provision can be made for at least one of the deflection elements to be formed as an annular mirror. Such an annular deflection mirror can surround e.g. a further deflection element, in particular a further deflection mirror, in an annular fashion. As a result, an especially compact arrangement can be attained. The further deflection element can also be arranged in relation to the annular mirror in a longitudinally offset manner to the mirror normal. If four deflection elements are provided it is especially advantageous that, for the purpose of a particularly compact arrangement, two of the deflection elements are formed as annular mirrors. For best suitability, the annular mirrors are arranged in a circular manner, which can mean in particular that they surround a further deflection element.

With regard to versatility it is furthermore advantageous that at least one of the deflection mirrors has a stepped mirror surface. This embodiment allows for the production of several partial images with different angular positions by means of a single deflection mirror. Consequently, with the minimum of equipment required and/or adjustment necessary it is possible to produce especially complex tilt images that represent particularly effective security features.

In addition, it is of advantage that at least one deflection element has a transmissive element. Such a deflection element permits the passage of at least a part of the light intensity. Once the light has passed through the transmissive deflection element the light can then fall on the tilt image structure. Likewise, it is of advantage in accordance with the invention that the deflection element has a diffractive optical element. Such a deflection element makes use of diffractive effects for the deflection of light. The diffractive element can be designed as a transmissive element or as a mirror.

Another advantageous further development of the device according to the invention resides in that it is adapted for writing on several surfaces of the base body. This proves to be especially advantageous if the base body has an extensive three-dimensional structure. For example the device can be employed for marking plug-connectors. In particular, provision can be made for a lateral marking and a surface marking in one and the same device. The invention therefore also comprises the use of a device according to the invention for marking an object, in particular a plug-connector, whereby several surfaces of different orientation, as for example an upper side and a lateral side, are preferably marked with one and the same device.

For the marking of several surfaces corresponding deflection optics can be provided that direct the laser light in each case to the desired surface of the base body. However, provision can also be made for a movable holder for the base body, with which the orientation of the base body relative to the laser light source can be changed. Alternatively or additionally, several laser light sources can also be provided that permit in particular a simultaneous marking of several surfaces. On the different surfaces tilt image structures but also simple structures without lenticular screen optics can be marked.

The method in accordance with the invention is characterized in that in the beam area of the laser light source two deflection elements for the laser light are provided and in that the deflection elements are illuminated, in particular in chronological succession, with laser light from the laser light source, whereby laser light of the laser light source that is deflected, in particular reflected by the deflection elements is in each case incident on the tilt image structure at a different angle of incidence.

The method according to the invention can be carried out in particular by means of a device according to the invention, whereby the advantages set out in this conjunction can be achieved.

BRIEF DESCRIPTION OF THE DRAWINGS

In the following the invention will be described in greater detail by way of preferred embodiments shown schematically in the accompanying figures, wherein.

DETAILED DESCRIPTION OF THE INVENTION

Elements having the same effect are designated in the figures with the same reference signs.

Figure 1:
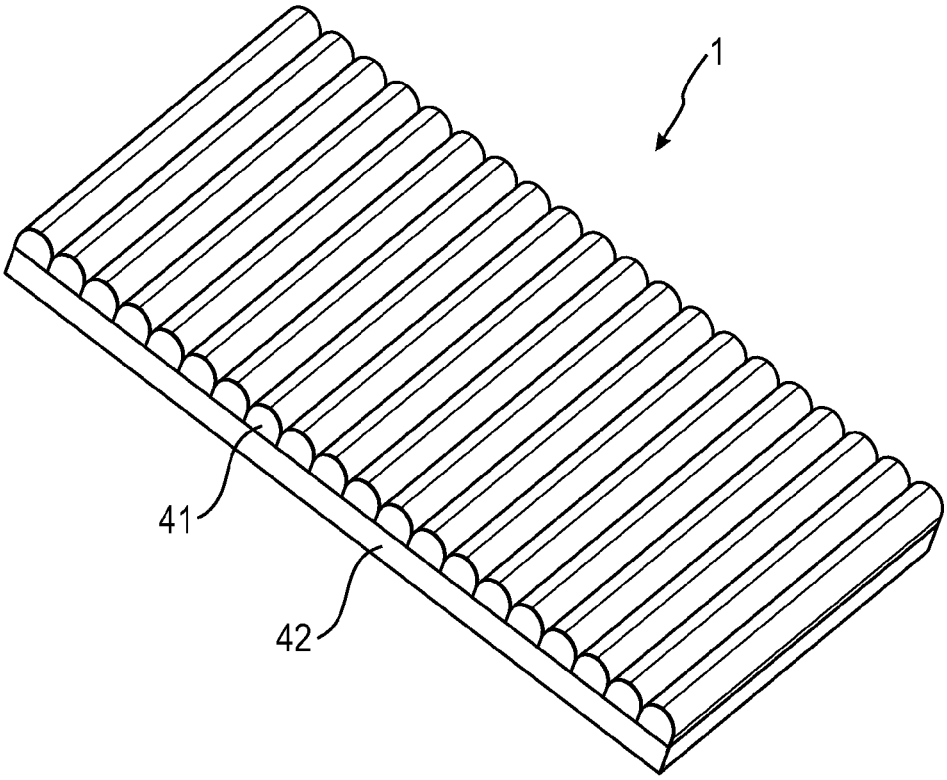
FIG. 1 shows a schematic view of a tilt image structure with cylindrical lenses.

FIG. 1 shows a tilt image structure 1 which can be written on by means of a device according to the invention and/or a method according to the invention. The tilt image structure 1 has a lenticular screen structure with a plurality of paraxially extending cylindrical lenses 41. Underneath these cylindrical lenses 41 a layer-shaped information carrier structure 42 is provided that contains optical image information. Depending on the viewing angle of the tilt image structure 1 the cylindrical lenses 41 show the viewer different partial images of the information carrier structure 42.

Figure 2:
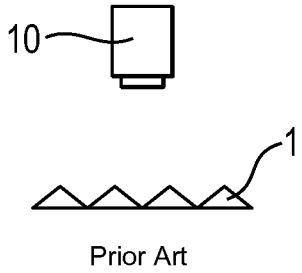
FIGS. 2 to 5 show method steps during writing on a tilt image structure in accordance with the prior art.
Figure 3:
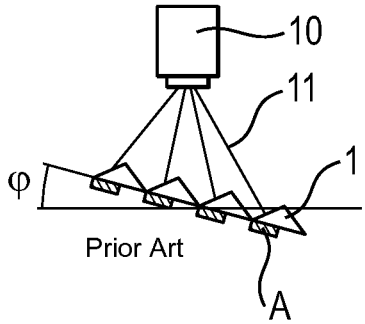

A method for writing on such a tilt image structure 1 in accordance with the prior art is shown in FIGS. 2 to 5. Here, provision is made for the tilt image structure 1 to be arranged below a laser light source 10 in the beam area of the laser light source 10 (FIG. 2).

The tilt image structure 1 is then tilted by an angle $\phi$ with respect to the irradiation plane of the laser light source 10. The laser light source 10 is activated and a laser beam 11 is generated. By means of this laser beam 11 a first image A is written into the information carrier structure of the tilt image structure 1 (compare FIG. 3).

Figure 4:
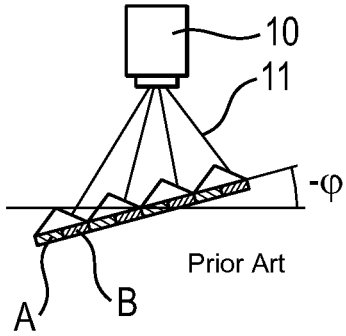

Afterwards, as shown in FIG. 4, the tilt image structure 1 is tilted in the opposite direction so that it becomes arranged by the angle $-\phi$ with respect to the irradiation plane of the laser light source 10. The laser light source 10 is activated once more and the second image B is written by means of a laser beam 11.

Figure 5:
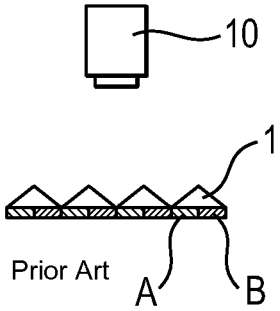
Figure 5:
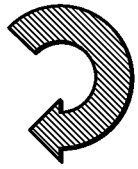

As depicted in FIG. 5, the tilt image structure 1 is then tilted back and removed from the writing device.

Figure 6:
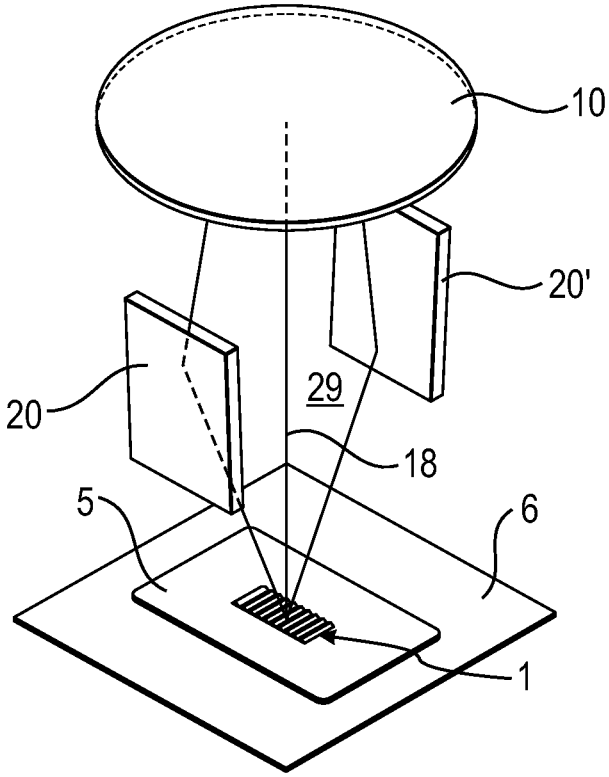
FIG. 6 shows a device for writing on a tilt image structure according to a first embodiment of the invention.

A device according to the invention for carrying out the method according to the invention is shown schematically in FIG. 6. The illustrated device serves for writing on a tilt image structure 1 on a base body 5 designed as an identification card. To hold this base body 5, designed as an identification card, a holder 6 is provided.

As shown in FIG. 6, in the beam area of the laser light source 10, which is only depicted in an extremely schematic manner, two deflection elements 20, 20' formed as mirrors are provided. Here, the deflection elements 20, 20' are arranged substantially parallel and provided in an axially symmetrical manner with respect to the optical axis 18 of the laser light source 10. When the deflection elements 20, 20' are irradiated by the laser light source 10, the light reflected by them falls on the tilt image structure 1 of the base body 5 accommodated in the holder 6 and depending on the irradiated deflection element 20 or 20' this takes place at a different angle of incidence. The deflection elements 20, 20' are arranged such that the amount of the angle of incidence on the tilt image structure 1 is roughly equal for both deflection elements 20 and 20', but depending on the irradiated deflection element 20 or 20' the angle of incidence has a different sign.

Figure 7:
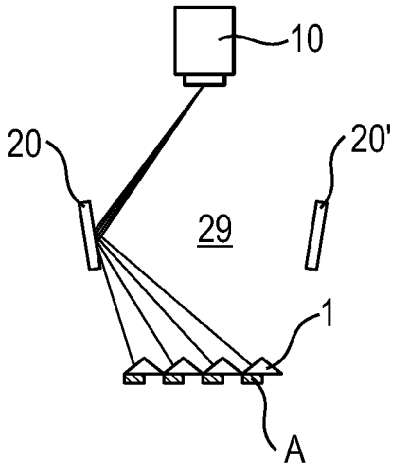
FIGS. 7 and 8 show method steps for writing on a tilt image structure in a method according to the invention by means of a device according to the invention.
Figure 8:
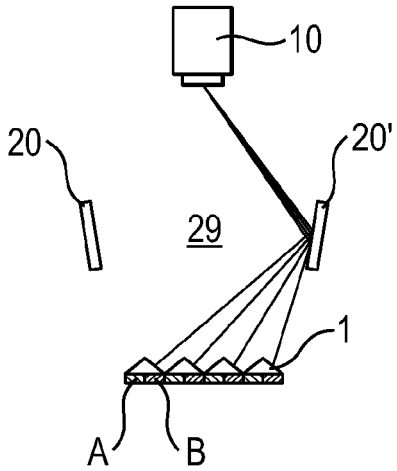

The procedure for writing on a tilt image structure 1 by means of the device shown in FIG. 6 is depicted in FIGS. 7 and 8.

As shown in FIG. 7, following the introduction of the tilt image structure 1 into the holder 6 the laser light source 10 is activated and directed onto the first deflection element 20. Light reflected from there is incident on the tilt image structure 1 where the first image A is written by the light.

In the ensuing step shown in FIG. 8 the second deflection element 20' is irradiated and by way of this second deflection element 20' the second image B is written. The base body with the tilt image structure 1 is then ready for being removed.

As illustrated in FIGS. 6 to 8, between the deflection elements 20 and 20' a free space 29 is formed, through which the tilt image structure 1 and/or surrounding areas of the base body 5 can be written on directly with light from the laser light source 10. Such a direct writing can take place before or after the steps shown in FIGS. 7 and 8.

In a writing method of a tilt image it is as a rule of no importance whether a mirror deflects the beam or whether the laser beam is directly incident on the writing plane. For geometrical reasons the path length can remain constant and normally focal distance or image distortion correction is not necessary either.

Figure 9:
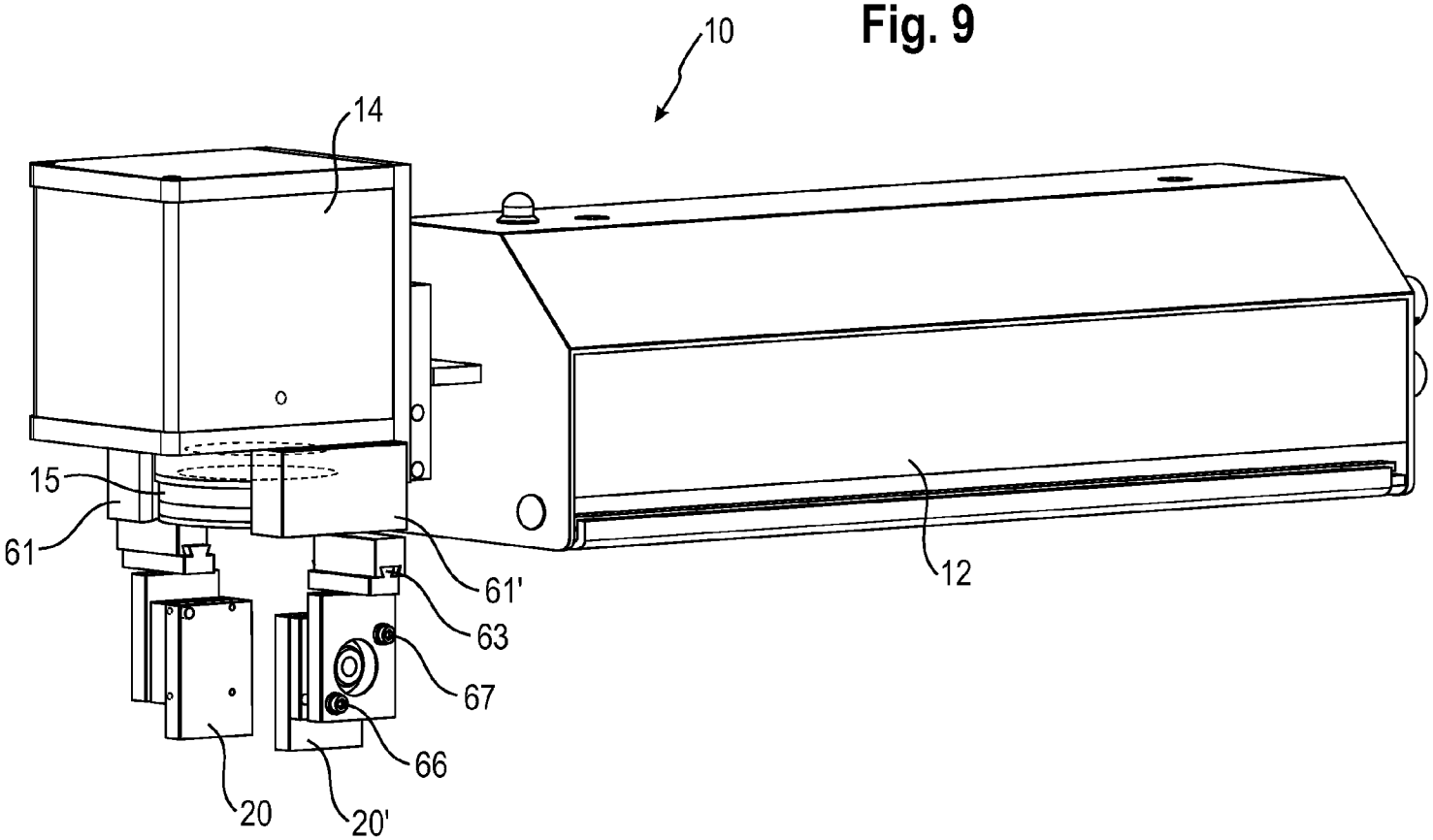
FIG. 9 shows a perspective view of a device according to the invention pursuant to a further embodiment.

Another embodiment of a device according to the invention for carrying out the method according to the invention is shown in FIG. 9. The device has a laser light source 10 with a laser 12, on the beam output of which a control means 14 designed as a scanner is provided. This control means 14 deflects a laser beam generated by the laser 12 by at least approximately 90°, in which case the exact angle of emergence of the laser beam from the control means 14 depends on the control signal. At the beam output of the control means 14 a lens 15 is provided that can be designed in particular as a flat field lens.

On the control means 14 two support elements 61, 61' are provided that protrude in a fork-like manner from the control means 14 on either side of the lens 15. At the end of the support elements 61, 61' the deflection elements 20, 20' formed as deflection mirrors are arranged.

The support elements 61, 61' each have a movement link 63, by means of which the respective deflection element 20 or 20' can be moved relative to the control means 14, namely in particular in a direction extending transversely to the optical axis of the laser light source 10. Moreover, on the support elements 61, 61' two adjusting screws 66 and 67 are provided each that permit a selective tilting of the deflection elements 20 and 20' respectively.

The invention claimed is:

1. Device for writing a tilt image structure on a base body, the device comprising:

a laser light source having a beam area and including a control component for selectively modifying an angle of emergence of laser light from the laser light source, and a holder for the base body, wherein the beam area of the laser light source includes at least two deflection elements for deflecting at least two portions of the laser light, the at least two deflection elements being arranged such that the portion of laser light of the laser light source that is deflected by each of the at least two deflection elements is incident on the tilt image structure of the base body accommodated on the holder at a different angle of incidence, wherein the at least two deflection elements consist of four deflection elements, each of the four deflection elements being arranged such that laser light of the laser light source that is reflected by each of the four deflection elements is incident on the tilt image structure of the base body accommodated on the holder at a different angle of incidence for writing different images of the tilt image structure, and wherein at least one of the four deflection elements is formed as an annular mirror which surrounds one of the remaining deflection elements in the four deflection elements.

2. Device according to claim 1, wherein the at least two deflection elements include at least two deflection mirrors.

3. Device according to claim 2, wherein the mirror surface of at least one deflection mirror is tilted with respect to an optical axis of the laser light source.

4. Device according to claim 1, wherein the at least two deflection elements have the same distance to the tilt image structure of the base body accommodated on the holder.

5. Device according to claim 1, wherein the at least two deflection elements have a different distance to the tilt image structure of the base body accommodated on the holder.

6. Device according to claim 1, wherein a free space exists between the at least two deflection elements, the free space including a direct irradiation of the base body with the laser light of the laser light source.

7. Device according to claim 1, wherein at least one of the deflection elements is pivotable.

8. Device according to claim 1, wherein a focus of the laser light source lies in a direction of a beam originating from the beam area behind the deflection elements.

9. Device according to claim 1, further comprising at least one of a pivotable mirror, prism or transmissive element arranged in one of a fixed manner in a path of a beam originating from the beam area or in a pivotable manner between in the path of the beam and outside the path of the beam.

10. Device according to claim 1, wherein at least one deflection element has at least one of a transmissive optical element or a diffractive optical element.

11. Device according to claim 1, wherein the laser light source and the holder are configured to write on several surfaces of the base body.

12. Device according to claim 1, wherein the laser light of the laser light source reflected by each of the four deflection elements is separately incident on the tilt image structure.

* * * * *